US010941776B2

(12) United States Patent
Reba et al.

(10) Patent No.: US 10,941,776 B2
(45) Date of Patent: Mar. 9, 2021

(54) SCREW COMPRESSOR RESONATOR ARRAYS

(71) Applicant: Carrier Corporation, Jupiter, FL (US)

(72) Inventors: Ramons A. Reba, South Windsor, CT (US); Arthur Blanc, Providence, RI (US); Duane C. McCormick, Colchester, CT (US); Mark W. Wilson, Syracuse, NY (US); David M. Rockwell, Cicero, NY (US); Benjamin J. Blechman, Fayetteville, NY (US)

(73) Assignee: Carrier Corporation, Palm Beach Gardens, FL (US)

( * ) Notice: Subject to any disclaimer, the term of this patent is extended or adjusted under 35 U.S.C. 154(b) by 271 days.

(21) Appl. No.: 15/760,273

(22) PCT Filed: Aug. 11, 2016

(86) PCT No.: PCT/US2016/046457

§ 371 (c)(1),
(2) Date: Mar. 15, 2018

(87) PCT Pub. No.: WO2017/058369

PCT Pub. Date: Apr. 6, 2017

(65) Prior Publication Data

US 2018/0258936 A1 Sep. 13, 2018

Related U.S. Application Data

(60) Provisional application No. 62/236,206, filed on Oct. 2, 2015.

(51) Int. Cl.
*F01C 13/00* (2006.01)
*F03C 2/00* (2006.01)
(Continued)

(52) U.S. Cl.
CPC ..... *F04C 29/065* (2013.01); *F04C 18/16* (2013.01); *F04C 29/04* (2013.01); *F04C 29/12* (2013.01)

(58) Field of Classification Search
CPC ..... F04C 18/16; F04C 29/04; F04C 29/063; F04C 29/065; F04C 29/066; F04C 29/068;
(Continued)

(56) References Cited

U.S. PATENT DOCUMENTS 3,871,800 A 3/1975 Slayton
4,573,324 A * 3/1986 Tischer ..... F04C 29/026 418/97
(Continued)

FOREIGN PATENT DOCUMENTS

CA 2197361 10/1997
CN 1212333 A 3/1999
(Continued)

OTHER PUBLICATIONS

Anatomy of a Grooved Pipe Joint, Jan. 2010, Victaulic, Easton, Pennsylvania.
(Continued)

*Primary Examiner* — Theresa Trieu
(74) *Attorney, Agent, or Firm* — Bachman & LaPointe, P.C.

(57) ABSTRACT

A compressor has a housing assembly having a plurality of ports including a suction port and a discharge A male rotor is mounted for rotation about an axis. A female rotor is enmeshed with the male rotor and mounted in the housing for rotation about an axis for drawing a flow from the suction port, compressing the flow, and discharging the compressed flow through the discharge port. A cavity group is between the discharge port and the male rotor and female rotor. The
(Continued)

cavity group has a first member separating a plurality of cells and a foraminate cover member atop the first member.

25 Claims, 9 Drawing Sheets

(51) Int. Cl.

| | |
|---|---|
| ***F03C 4/00*** | (2006.01) |
| ***F04C 2/00*** | (2006.01) |
| ***F04C 29/06*** | (2006.01) |
| ***F04C 18/16*** | (2006.01) |
| ***F04C 29/04*** | (2006.01) |
| ***F04C 29/12*** | (2006.01) |

(58) Field of Classification Search
CPC ... F04C 29/12; F01N 1/02; F01N 1/10; F01N 1/24; F01N 2310/00; F01N 2310/06
USPC ..... 418/181, 201.1; 181/212, 222, 256
See application file for complete search history.

(56) References Cited

U.S. PATENT DOCUMENTS

| | | | | |
|---|---|---|---|---|
| 4,934,482 | A | 6/1990 | Herron et al. | |
| 5,180,298 | A | 1/1993 | DiRe | |
| 5,205,719 | A | 4/1993 | Childs et al. | |
| 5,208,429 | A * | 5/1993 | Field | F02M 35/12 181/229 |
| 5,224,840 | A | 7/1993 | Dreiman et al. | |
| 5,507,151 | A | 4/1996 | Ring et al. | |
| 5,616,017 | A | 4/1997 | Iizuka et al. | |
| 6,095,777 | A | 8/2000 | Nishihata et al. | |
| 6,257,846 | B1 | 7/2001 | Muramatsu et al. | |
| 6,331,103 | B1 * | 12/2001 | Teraoka | F04C 15/06 418/181 |
| 6,360,555 | B1 | 3/2002 | Li et al. | |
| 6,902,381 | B2 | 6/2005 | Hur et al. | |
| 7,121,814 | B2 | 10/2006 | Rockwell et al. | |
| 7,156,624 | B2 | 1/2007 | Shoulders | |
| 7,568,898 | B2 | 8/2009 | Shoulders | |
| 7,604,467 | B2 * | 10/2009 | Prior | F04C 18/16 418/201.1 |
| 7,849,705 | B2 * | 12/2010 | Lee | F01N 1/04 181/252 |
| 7,988,427 | B2 | 8/2011 | Patrick | |
| 7,993,112 | B2 | 8/2011 | Rockwell | |
| 8,016,071 | B1 | 9/2011 | Martinus et al. | |
| 8,021,126 | B2 | 9/2011 | Sishtla et al. | |
| 8,317,489 | B2 | 11/2012 | Barth | |
| 8,496,446 | B2 | 7/2013 | Lai | |
| 8,845,312 | B2 | 9/2014 | Takaki | |
| 2003/0049146 | A1 | 3/2003 | Dieterich | |
| 2005/0144976 | A1 | 7/2005 | Sishtla | |
| 2006/0127235 | A1 | 6/2006 | Shoulders | |
| 2006/0165543 | A1 | 7/2006 | Fox et al. | |
| 2006/0239836 | A1 | 10/2006 | Forster | |
| 2007/0264146 | A1 | 11/2007 | Mosemann et al. | |
| 2007/0269325 | A1 | 11/2007 | Candio et al. | |
| 2008/0060622 | A1 * | 3/2008 | Prior | F04C 18/16 418/201.1 |
| 2008/0219863 | A1 | 9/2008 | Jung | |
| 2008/0284161 | A1 | 11/2008 | Dole et al. | |
| 2010/0209280 | A1 | 8/2010 | Flannigan et al. | |
| 2010/0218536 | A1 | 9/2010 | Rockwell | |
| 2015/0004015 | A1 | 1/2015 | Kienzle et al. | |
| 2016/0097572 | A1 | 4/2016 | Feller et al. | |

FOREIGN PATENT DOCUMENTS

| | | | |
|---|---|---|---|
| CN | 1221088 | A | 6/1999 |
| CN | 2002/053975 | A1 | 7/2002 |
| CN | 1499080 | A | 5/2004 |
| CN | 1851244 | A | 10/2006 |
| CN | 101072946 | A | 11/2007 |
| CN | 101144475 | A | 3/2008 |
| CN | 201462139 | U | 5/2010 |
| CN | 102878366 | A | 1/2013 |
| CN | 203404544 | U | 1/2014 |
| CN | 103821713 | A | 5/2014 |
| CN | 203822630 | U | 9/2014 |
| CN | 104204532 | A | 12/2014 |
| CN | 104411974 | A | 3/2015 |
| DE | 10011023 | A1 | 9/2001 |
| DE | 202005001600 | U1 | 4/2005 |
| DE | 202007005097 | U1 | 8/2008 |
| DE | 102013106344 | A1 | 12/2014 |
| EP | 0542169 | A1 | 5/1993 |
| EP | 0926414 | A2 | 6/1999 |
| FR | 1339407 | A | 10/1963 |
| JP | 54129017 | U | 9/1979 |
| JP | 57129286 | A | 8/1982 |
| JP | H01237389 | A | 9/1989 |
| JP | 07332267 | A | 12/1995 |
| JP | 08338386 | A | 12/1996 |
| JP | 2003184767 | A | 7/2003 |
| RU | 2435985 | C2 | 12/2011 |
| WO | 01/66946 | A1 | 9/2001 |
| WO | 02/053917 | A1 | 7/2002 |
| WO | 2008/045084 | A1 | 4/2008 |
| WO | 2011/152915 | A2 | 12/2011 |
| WO | 2015/006081 | A2 | 1/2015 |

OTHER PUBLICATIONS

Seal Selection Guide Elastometric Seal Construction, Mar. 2016, Victaulic, Easton, Pennsylvania.

Aquaforce 30XW150-400 Water-Cooled Liquid Chillers, Installation Instructions, Jul. 2012, Carrier Corporation, Jupiter, Florida.

International Search Report and Written Opinion dated Oct. 21, 2016, for PCT Patent Application No. PCT/US2016/046516.

High Flow Compressor Outlet Pipe for Evo X Turbo, Jul. 23, 2014, BC, Canada, retrieved from Internet Mar. 22, 2018 https://www.exoticspeed.com/products/high-flow-compressor-outlet-pipe-for-evo-x-turbo, Exotic Speed.

International Search Report and Written Opinion dated Oct. 26, 2016 for PCT Patent Application No. PCT/US2016/046457.

International Search Report and Written Opinion dated Oct. 13, 2016 for PCT Patent Application No. PCT/US2016/046459.

Chinese Office Action dated Apr. 25, 2019 for Chinese Patent Application No. 201680056844.5.

Chinese Office Action dated Jan. 2, 2019 for Chinese Patent Application No. 201680047232.X.

Fang Danqun, Aerodynamic Noise and Muffler, Aug. 31, 1978, pp. 140-146, Science Press, Beijing, China.

Chinese Office Action dated Nov. 29, 2018 for Chinese Patent Application No. 201680041008.X.

Russian Office Action dated Dec. 11, 2019 for Russian Patent Application No. 2018100095.

European Office Action dated Feb. 20, 2019 for European Patent Application No. 16754377.6.

* cited by examiner

SCREW COMPRESSOR RESONATOR ARRAYS

CROSS-REFERENCE TO RELATED APPLICATION

Benefit is claimed of U.S. Patent Application Ser. No. 62/236,206, filed Oct. 2, 2015, and entitled "Screw Compressor Resonator Arrays", the disclosure of which is incorporated by reference herein in its entirety as if set forth at length.

BACKGROUND

The disclosure relates to compressors. More particularly, the disclosure relates to pulsation control in screw compressors.

Gas pulsations generated in screw compressors are a dominant contributor to noise of current and future vapor compression systems such as chillers (e.g., both air-cooled and water-cooled). Pulsations generated at the discharge of the screw rotors propagate as refrigerant-borne waves through the compressor discharge line to downstream chiller components, exciting structural vibration which causes airborne sound/noise. Similarly, the refrigerant-borne pulsations within the compressor plenum cause the compressor housing to vibrate and radiate sound.

Prior technologies for controlling gas pulsations in screw compressors include external mufflers installed in the compressor discharge line as well as mufflers integrated with the compressor. Examples of mufflers integrated with the compressor are described in U.S. Pat. No. 8,016,071, Sep. 13, 2011, and International Publication No. WO/2001/066946 (Application No. PCT/EP2001/002578), Sep. 13, 2001.

SUMMARY

One aspect of the disclosure involves a compressor comprising a housing assembly having a plurality of ports including a suction port and a discharge port. A male rotor is mounted for rotation about an axis. A female rotor is enmeshed with the male rotor and mounted in the housing for rotation about an axis for drawing a flow from the suction port, compressing the flow, and discharging the compressed flow through the discharge port. A cavity group is between the discharge port and the male rotor and female rotor. The cavity group comprises a first member separating a plurality of cells and a foraminate cover member atop the first member.

In one or more embodiments of any of the foregoing embodiments, the cavity group is a resonator group.

In one or more embodiments of any of the foregoing embodiments, the first member is a unitary single piece first member.

In one or more embodiments of any of the foregoing embodiments, the foraminate cover is a flat plate.

In one or more embodiments of any of the foregoing embodiments, the foraminate cover has a characteristic thickness and holes of characteristic diameter between 1.0 times and 2.0 times said characteristic thickness.

In one or more embodiments of any of the foregoing embodiments, there are at least ten holes per cavity for a plurality of the cavities.

In one or more embodiments of any of the foregoing embodiments, the characteristic thickness is 1.5 mm to 3.0 mm.

In one or more embodiments of any of the foregoing embodiments, the discharge port is transversely offset from a discharge valve seat opening so as to be non-overlapping in axial projection.

In one or more embodiments of any of the foregoing embodiments, the cavity group is at a discharge end of a bearing case.

In one or more embodiments of any of the foregoing embodiments, the first member is mounted to the discharge end of the bearing case.

In one or more embodiments of any of the foregoing embodiments, a motor is contained by the housing.

In one or more embodiments of any of the foregoing embodiments, the cells are unfilled.

In one or more embodiments of any of the foregoing embodiments, the cells have hydraulic diameters of 10 mm to 50 mm.

In one or more embodiments of any of the foregoing embodiments, the cavity group is a first cavity group and the compressor further comprises a second cavity group between the discharge port and the male rotor and female rotor. The second cavity group is positioned opposite the first cavity group about a flowpath through the compressor and comprises: a unitary single-piece first member separating a plurality of cells; and a foraminate cover member atop the first member.

In one or more embodiments of any of the foregoing embodiments, a separation between the first cavity group and the second cavity group is 20 mm to 60 mm.

In one or more embodiments of any of the foregoing embodiments, the respective cover members of the first cavity group and the second cavity group are parallel.

In one or more embodiments of any of the foregoing embodiments, the respective cover members of the first cavity group and the second cavity group are orthogonal to the rotation axes of the male rotor and female rotor.

In one or more embodiments of any of the foregoing embodiments, a central barrier splits a flowpath along the cavity group.

In one or more embodiments of any of the foregoing embodiments, the central barrier projects from a discharge cover toward the cavity group.

In one or more embodiments of any of the foregoing embodiments, the cavity group is along a flowpath between a discharge plenum in a bearing case and the discharge port and the discharge port is offset from a downstream end of the discharge plenum transversely to rotation axes of the one or more working elements.

Another aspect of the disclosure involves a vapor compression system comprising the compressor, and further comprising: a heat rejection heat exchanger; a heat absorption heat exchanger; and a flowpath from the discharge port sequentially through the heat rejection heat exchanger and heat absorption heat exchanger and returning to the suction port.

In one or more embodiments of any of the foregoing embodiments, the vapor compression system is a chiller.

In one or more embodiments of any of the foregoing embodiments, a method for operating the compressor or vapor compression system comprises: driving rotation of the male rotor and the female rotor to draw the flow from the suction port, compress the flow, and discharge the compressed flow through the discharge port; and the compressed flow passing along the cavity group.

In one or more embodiments of any of the foregoing embodiments, the cavity group acts as a resonator array to partially cancel pulsations.

The details of one or more embodiments are set forth in the accompanying drawings and the description below. Other features, objects, and advantages will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
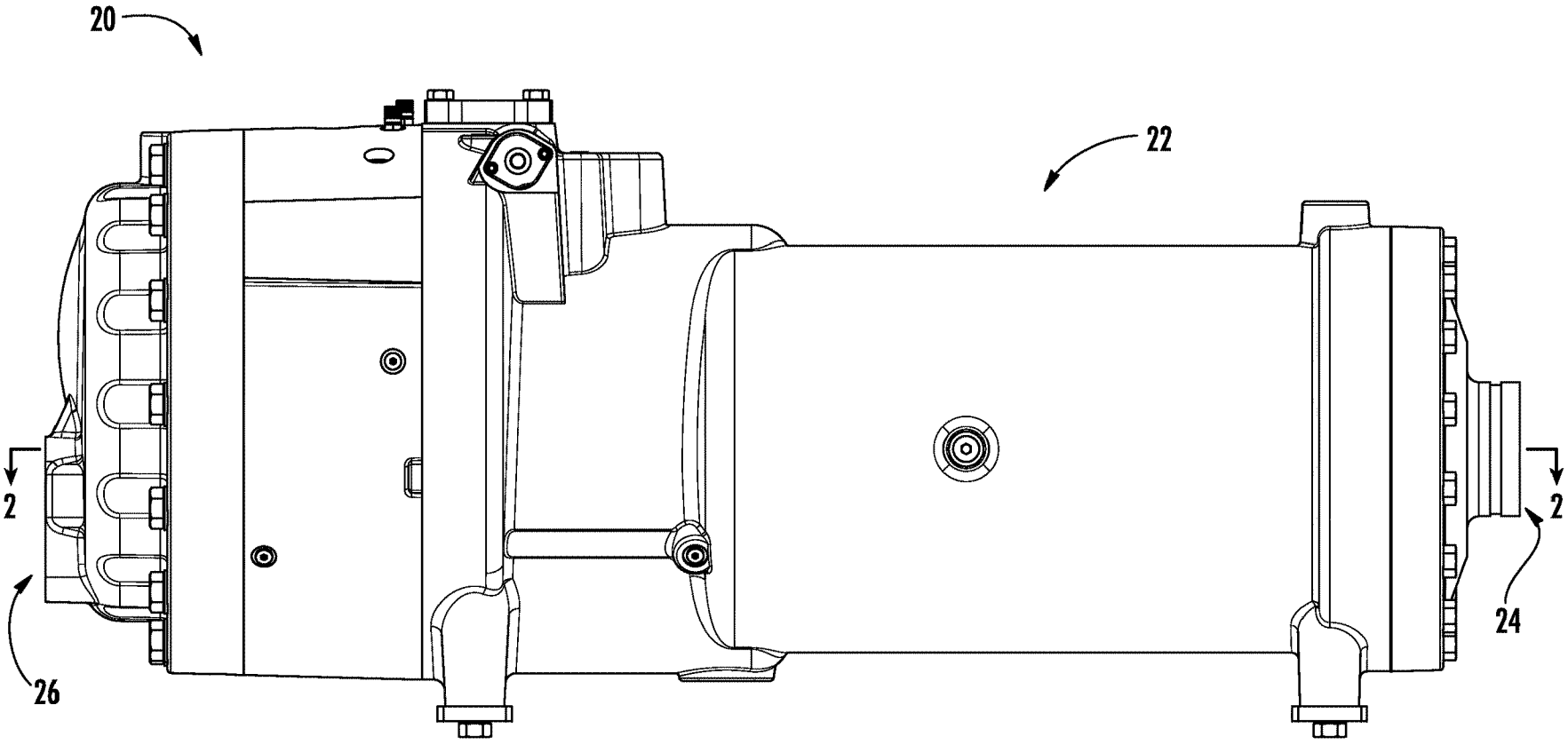
FIG. 1 is a side view of a screw compressor.

FIG. 1 shows a screw compressor 20 having a housing or case (case assembly) 22 including an inlet or suction port 24 and an outlet or discharge port 26. The exemplary suction port 24 and discharge port 26 are axial ports (facing in opposite directions parallel to rotor axes). The case assembly comprises several main pieces which may be formed of cast or machined alloy.

Figure 2:
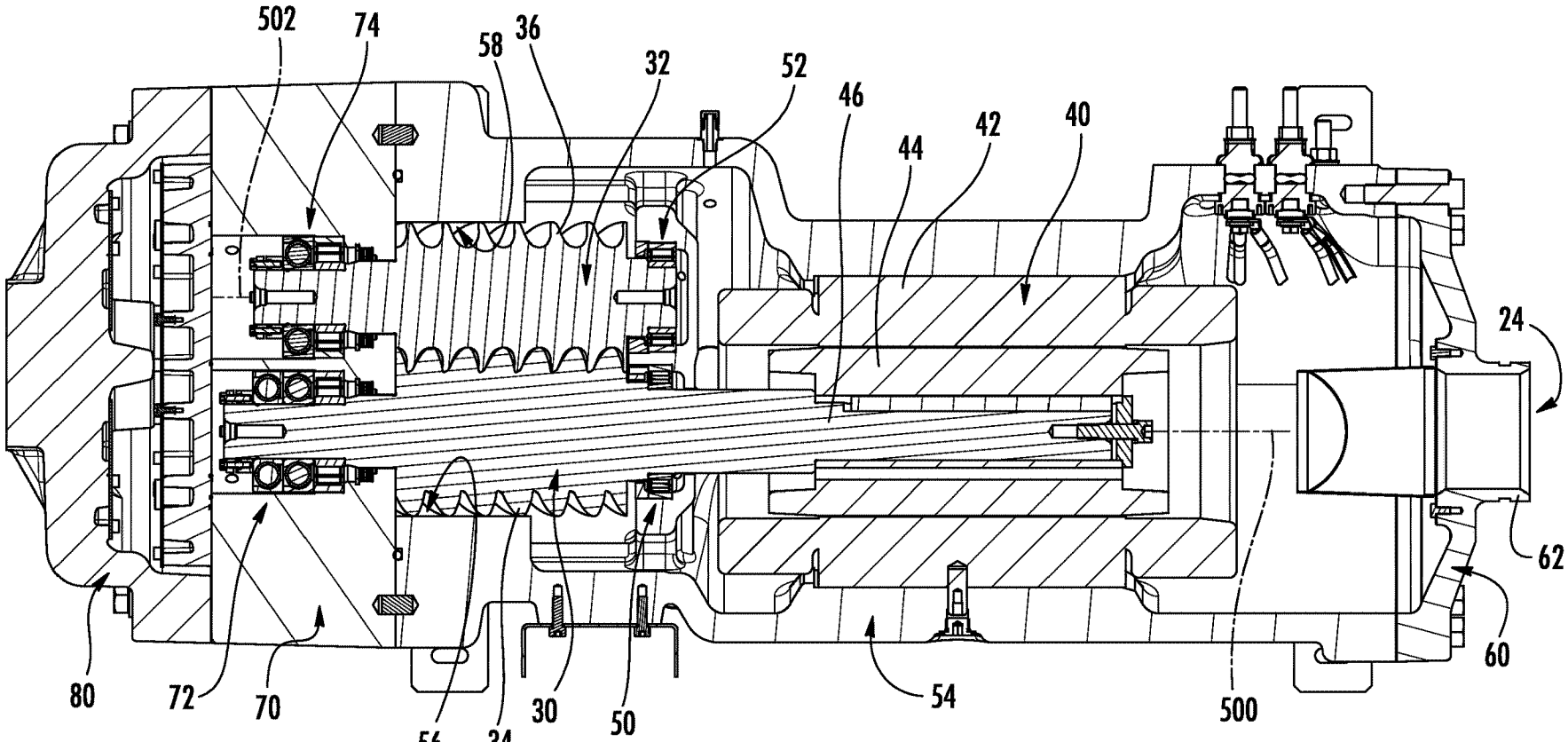
FIG. 2 is a central horizontal sectional view of the compressor taken along line 2-2 of FIG. 1.

FIG. 2 shows an exemplary compressor as being a screw compressor, more particularly, a two-rotor direct drive semi-hermetic screw compressor. The exemplary screws are a respective male rotor 30 and female rotor 32. The male rotor has a lobed working portion 34. The female rotor has a lobed working portion 36 enmeshed with the male rotor working portion 34. In the exemplary embodiment, the male rotor is driven for rotation about an axis 500 by a motor 40 having a stator 42 and a rotor 44. The exemplary drive is direct drive with an upstream shaft 46 of the male rotor mounted in the rotor 44. The driving of the male rotor causes the cooperation between lobes to, in turn, drive rotation of the female rotor about its axis 502.

The exemplary rotors are supported for rotation about their respective axes by one or more bearings (e.g., rolling element bearings) along shaft portions protruding from opposite ends of each such rotor working portion. In an exemplary embodiment, upstream end bearings 50 and 52, respectively, are mounted in associated compartments in a main casting (main case member) 54 of the case assembly which forms a rotor case and the body of a motor case. The rotor case portion defines respective bores 56 and 58 accommodating the lobed working portions. At an upstream end of the motor case portion, a motor case cover or endplate 60 encloses the motor case and provides the inlet port such as via an integral fitting 62. The exemplary cover 60 is secured to the upstream end of the main case member 54 via a bolt circle extending through bolting flanges of the two.

Figure 3:
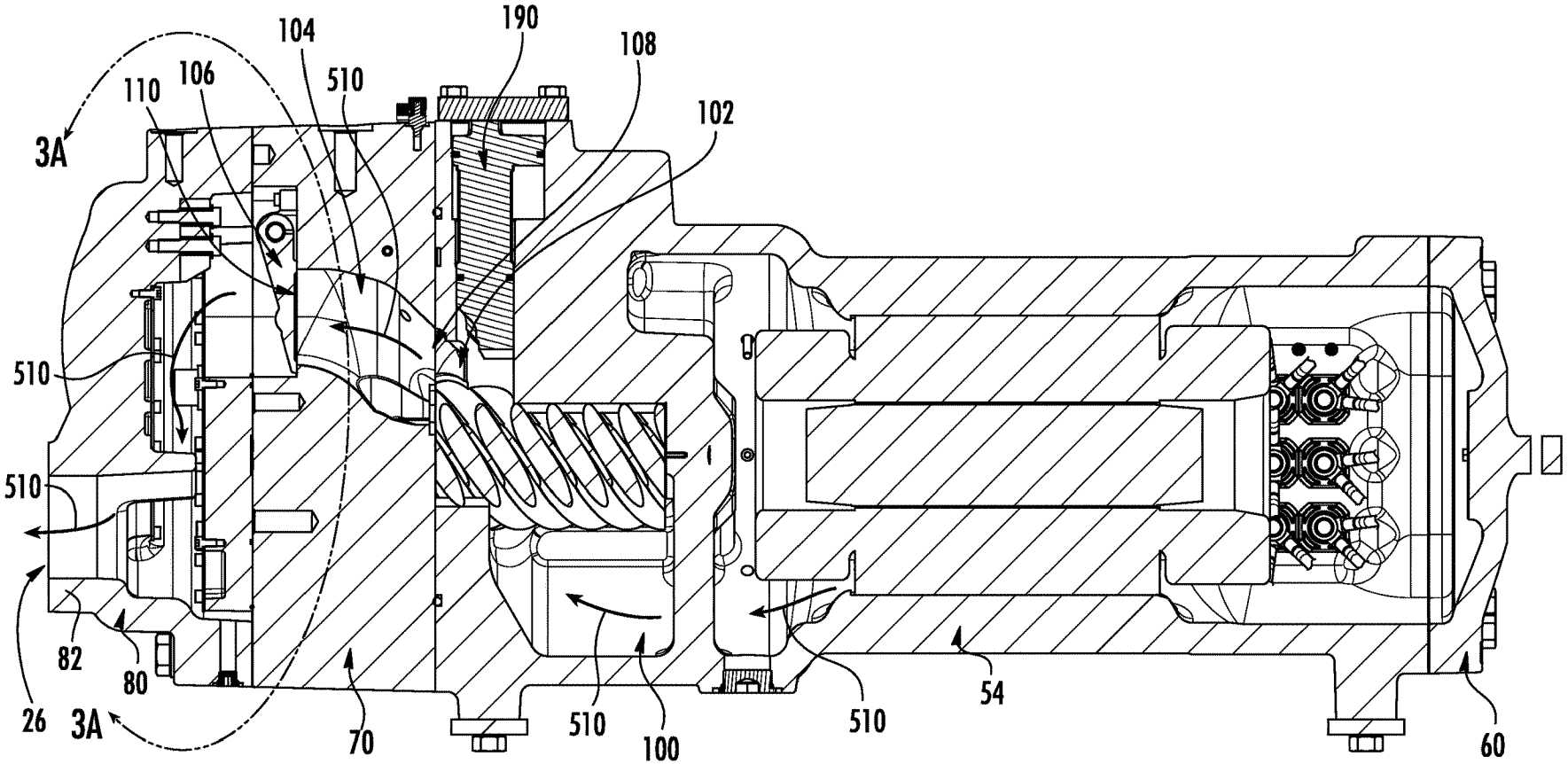
FIG. 3 is a longitudinal vertical sectional view of the compressor taken along line 3-3 of FIG. 2.

At the downstream end of the main case member 54, the case assembly includes a separate bearing case member (discharge end bearing case) 70 which has bearing compartments in which the respective discharge end bearings 72 and 74 of the male rotor and female rotor are mounted. A discharge case (cover or endplate) 80 may cover the bearing case 70 and may provide the discharge port such as via a fitting 82 (FIG. 3). The discharge cover 80 may be secured such as via a bolt circle. In one exemplary implementation, the bolts extend through the bearing case to the main case member 54 downstream end.

In operation, the exemplary flowpath 510 through the compressor passes from the suction port 24 through the motor case (around and/or through the motor), into a suction plenum 100 (FIG. 3) of the rotor case and then through the enmeshed rotors wherein flow is compressed. The flowpath passes into a discharge plenum 102 portion of the rotor case and then through a discharge passageway 104 of the bearing case which forms an extension of the discharge plenum. A discharge valve 106 (e.g., a spring-loaded flapper valve) may control flow through the discharge plenum to prevent backflow. In the exemplary embodiment, the passageway 104 radially diverges from an inlet end 108 to an outlet end 110 so that the outlet end is at a relatively outboard location in the bearing case 70. This location is substantially offset from the discharge port 26 (e.g., approximately diametrically offset with the exemplary nominal circular planform of the bearing case and discharge cover). In the exemplary embodiment, the end 110 is at the twelve o'clock position looking upstream while the discharge port 26 is at the six o'clock position. This offset causes the flowpath to need to proceed transversely downward from the end 110 and valve 106 to get to the discharge port. This offset breaks line-of-sight between the discharge plenum and the discharge port to help dissipate pulsations generated by the opening of compression pockets to the discharge plenum.

Figure 3A:
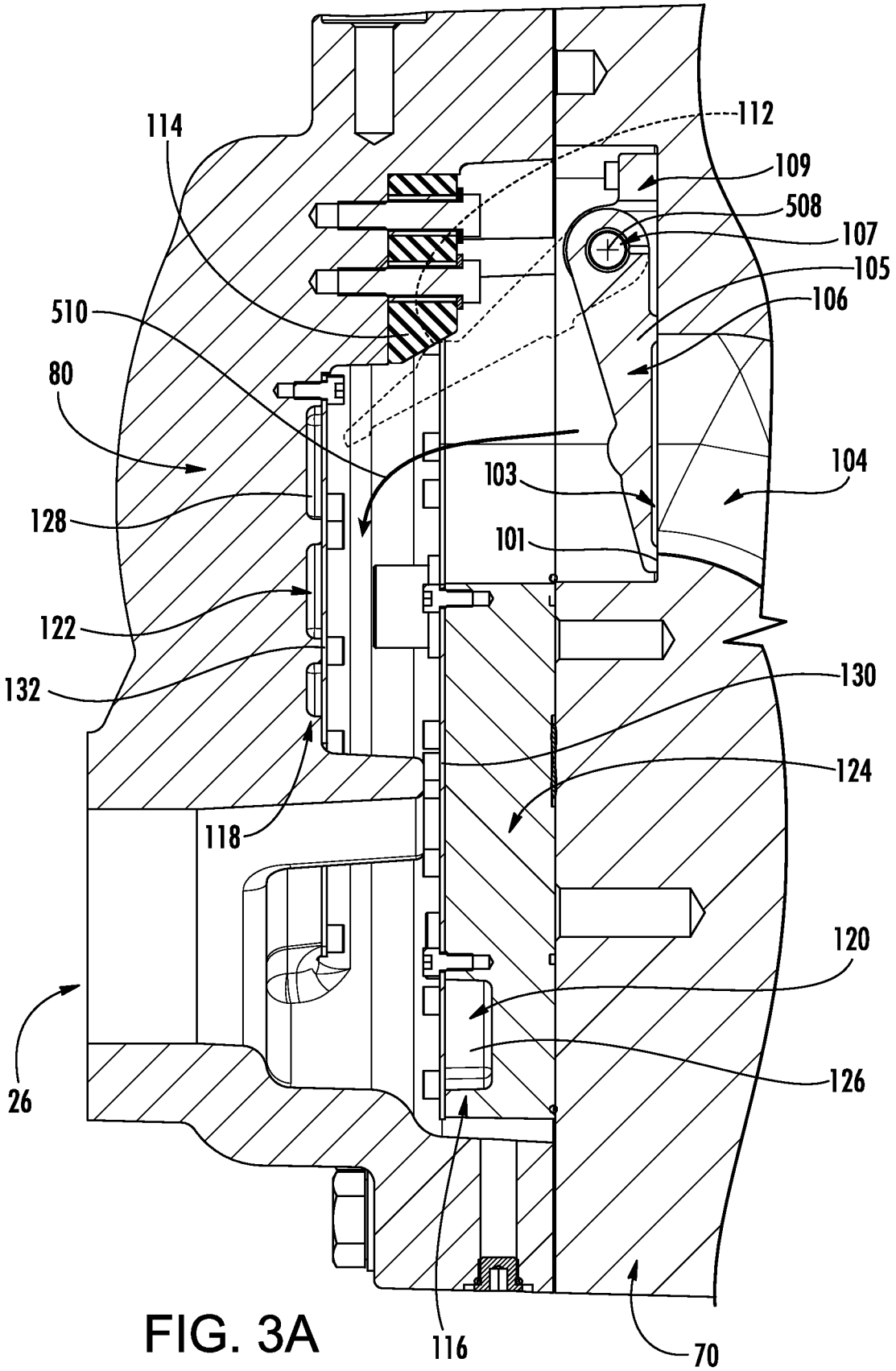
FIG. 3A is an enlarged view of a discharge end of the compressor of FIG. 3.

To further guide flow, the flapper 105 of the valve 106 may have an unusually restricted range of motion. FIG. 3A has a broken line showing of the flapper in a stopped open condition. FIG. 3A has a solid line showing of the flapper in a closed condition against a discharge valve seat 101 surrounding a discharge valve seat opening 103. A pivot (e.g., axle) 107 mounts the flapper for rotation about an axis 508 (e.g., a horizontal transverse axis) relative to a base 109 of the valve. The exemplary stopped condition involves a rotation of less than 90° (e.g., 55° to 90° or 55° to 80° or 60° to 75°) about the axis from the closed condition. The stopped condition is determined by the contact of a stop feature (e.g., a projection 112) on the backside of the flapper 105 with a bumper 114 (e.g., rubber or synthetic elastomer) mounted to the discharge housing (e.g., via screws). The limited range allows the flapper underside to deflect the flow along the flowpath 510 downward toward the discharge port.

Several further features help reduce the effect of initial pulsations. One such further feature is the location of resonators 116 and 118 (FIG. 3A) along the flowpath between the discharge plenum/passageway 104 in the bearing case and the discharge port 26. The resonators 116 and 118 are each formed as resonator groups or arrays 116 and 118 of individual resonators 120 and 122, respectively. In the exemplary embodiment, the respective arrays of resonators are on opposite longitudinal sides of the flowpath with the resonators 120 relatively toward the suction end of the compressor and the resonators 122 relatively toward the discharge end of the compressor. Thus, the resonators 120 may be formed in the bearing case 70 or, in the exemplary embodiment, formed in a member 124 mounted to the bearing case (to the discharge end face of the bearing case). The exemplary resonators 122, however, are formed in the inlet end surface of the discharge cover 80. As is discussed further below, each of the resonators 120 and 122 is formed by a combination of a recess or cell 126, 128 in the associated member and a foraminate or apertured cover 130, 132 (e.g., alloy plates such as a steel) whose holes 134 (e.g., stamped or drilled circular holes (FIGS. 5 and 6)) form openings to compartments formed by the recesses.

Figure 5:
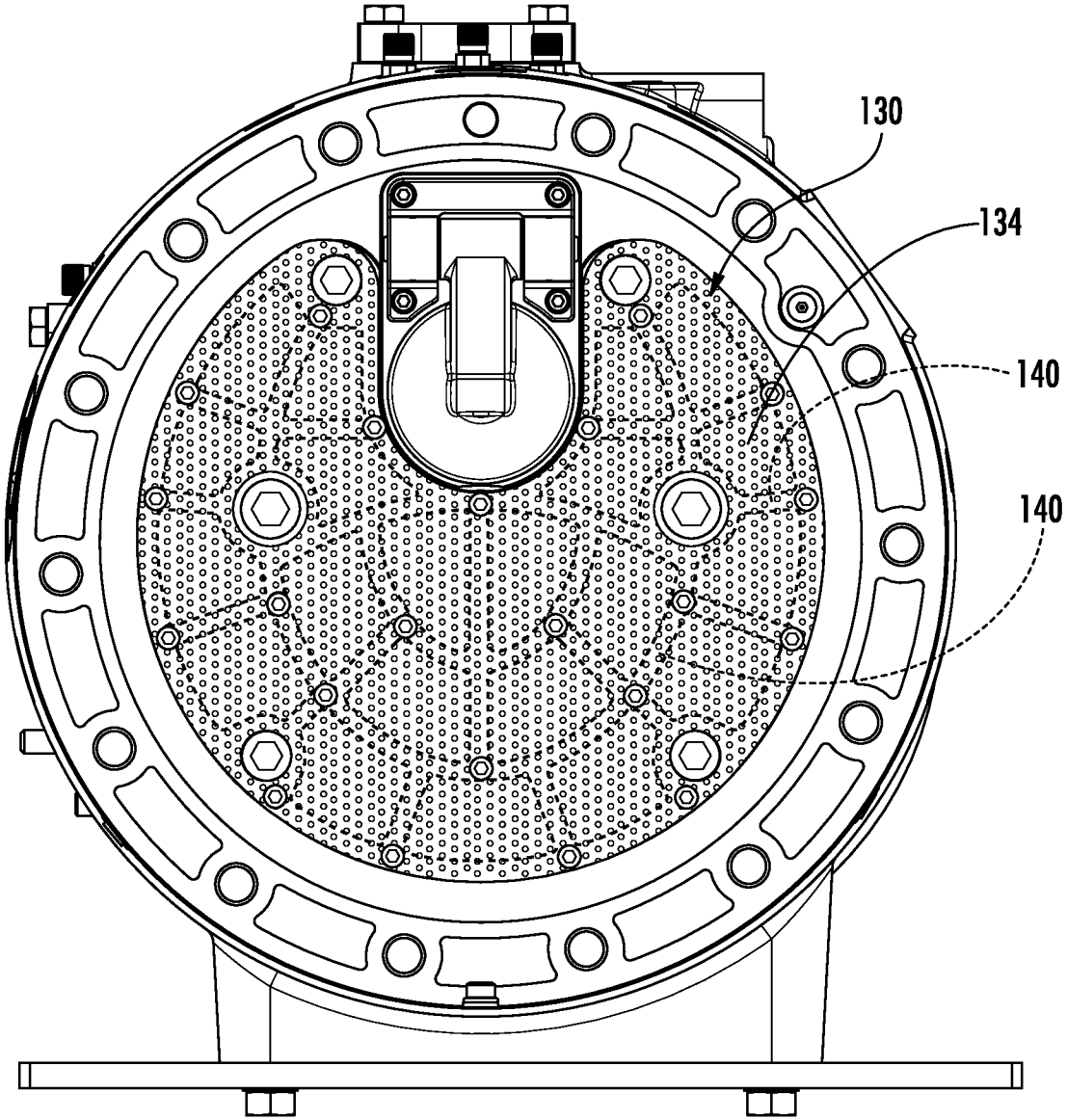
FIG. 5 is an upstream view of the compressor with discharge cover assembly removed.
Figure 6:
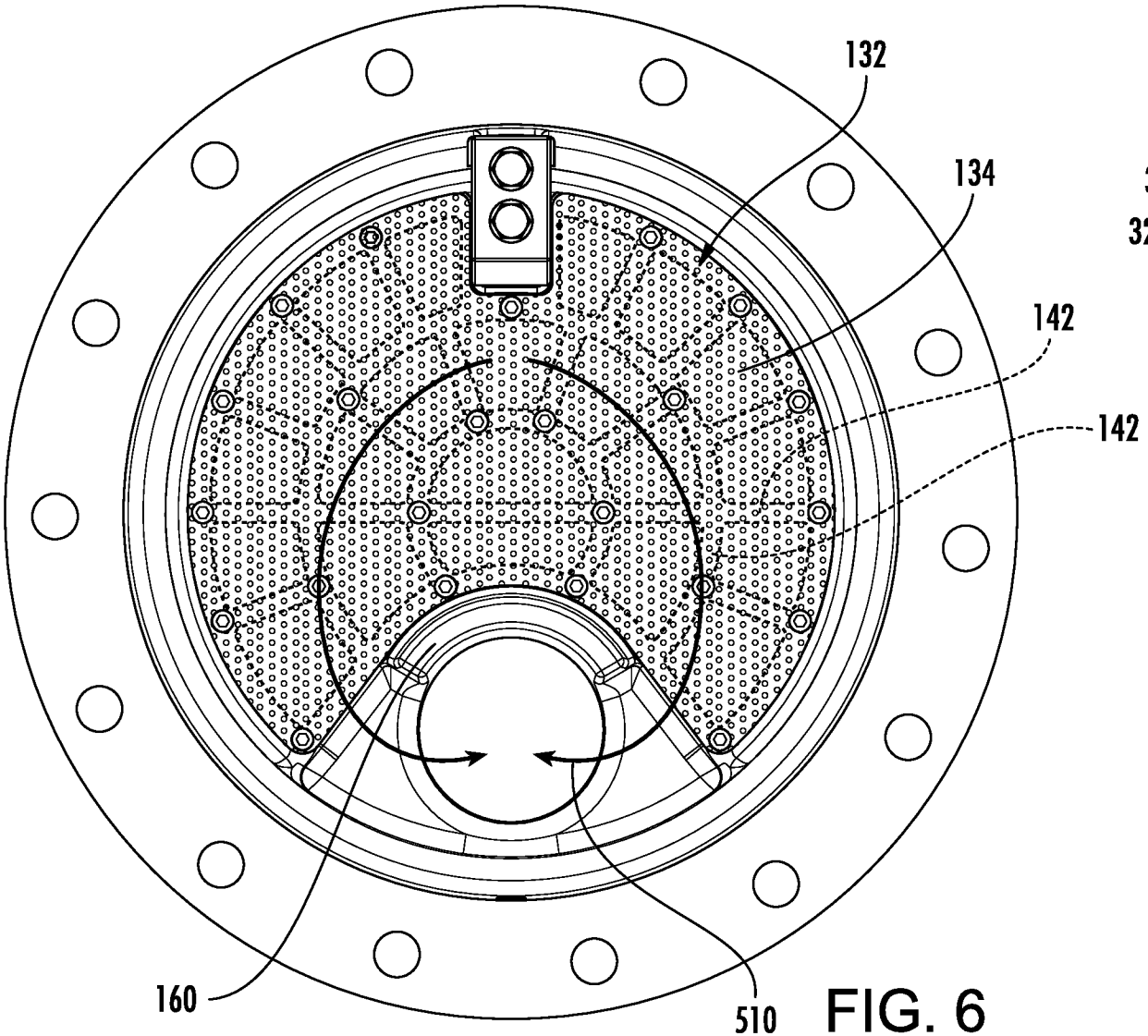
FIG. 6 is a downstream view of the discharge cover assembly.

FIGS. 5 and 6 show a layout of individual recesses separated by respective dividing walls 140 and 142.

Figure 4:
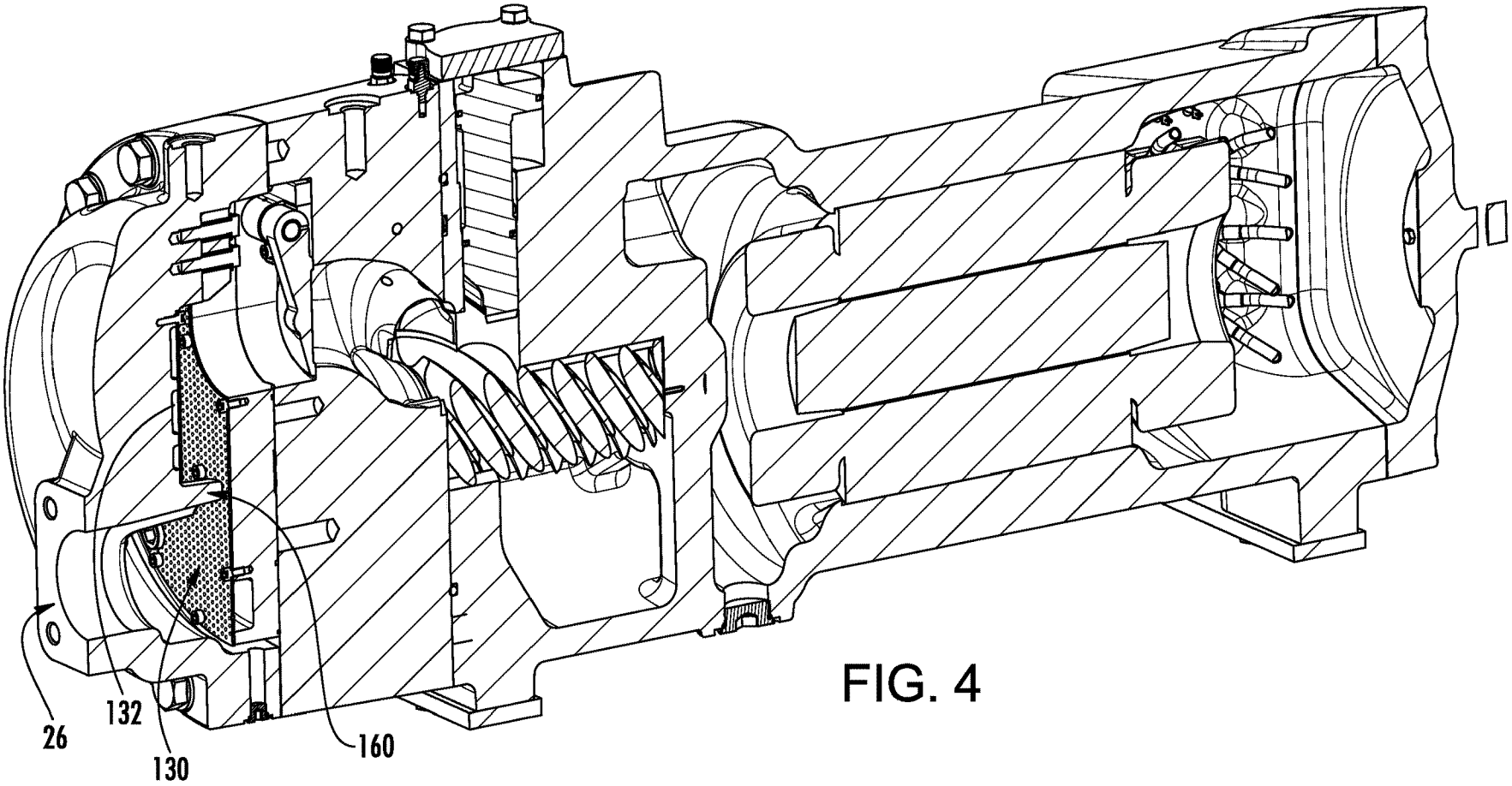
FIG. 4 is a view of the compressor cutaway at the 3-3 line of FIG. 2.

The third feature for limiting the effects of pulsations is the addition, in the inlet end face of the discharge cover, of a barrier 160 (FIG. 4) for laterally diverting the downward flow prior to encountering the discharge port. FIG. 6 shows this barrier positioned to laterally divert the refrigerant flows and thus temporarily at least partially bifurcate the flowpath 510 into respective lateral branches. In addition to disrupting line-of-sight, this extends the overall flowpath length and the length of exposure to the resonators.

The particular parameters of the resonator recess size and shape (lateral dimensions, depth, and the like) and aperture size (transverse dimensions and potentially plate thickness) and distribution may be tailored via experimental methods or via computer simulation. Cavity size may be selected based on the range of sound frequencies (or wavelengths $\lambda$) sought to be countered. Exemplary hydraulic diameter is 0.25 times to 0.50 times $\lambda$. Such selection of hydraulic diameter may be done by the designer directly of may be programmed into a computer-aided engineering process or may result from the computer-aided engineering process. An exemplary $\lambda$ is based on the frequency. An exemplary frequency is the number of compression pocket openings to discharge per unit of time at an operational speed of the compressor. Additional relevant frequencies are the harmonics of those frequencies. $\lambda$ is the speed of sound divided by the frequency. Hydraulic diameter of at least one cavity may be selected for each of a plurality of respective $\lambda$ in the target operating range of the compressor. Exemplary sound speed will depend on the particular refrigerant and the discharge pressure. Exemplary refrigerants include R134a and R1234ze. Exemplary number of compression pocket openings per second is 140 Hz to 700 Hz with harmonics then extending the upper range of frequency to about 5 kHz (e.g., seven times the exemplary 700 Hz).

Exemplary thickness for the plates 130 and 132 is 1.0 mm to 5 mm, more particularly, 1.5 mm to 3.0 mm. In general, lower values are more desirable but subject to thresholds for robustness and lack of vibration themselves. Exemplary hole diameter (or other characterization transverse dimension if non-circular holes are used) is between 0.5 times and 4.0 times the plate thickness, more particularly, between 1.0 times and 2.0 times. Thus, exemplary diameters would be 1.5 mm to 6.0 mm given the example above or 1.5 mm to 3.0 mm. There may me multiple holes/apertures for each cell (e.g. at least ten or twenty per cell). The exemplary aperture plates have a continuous array of the holes spanning all the associated cells. Other configurations might group the apertures with specific cells. Exemplary arrays are regular arrays such as square, rhomboidal, or hexagonal.

The exemplary cavities function a multi-modal non-linear resonators. In contrast with a Helmholtz resonator, the cavity dimensions are designed to be acoustically non-compact over the range of relevant frequencies (e.g., a portion of the operational range targeted for dissipation). This allows both transverse (side-to-side) and longitudinal (front-to-back) modes. This is in contrast with Helmholtz resonators where cavity dimensions are acoustically compact, and in contrast with conventional quarter-wave resonators where longitudinal modes drive resonances. As a result, a much broad attenuation bandwidth may be obtained.

Nevertheless, at lower speeds, the exemplary resonators may begin to act as Helmholtz resonators.

In addition, the exemplary resonators make use of on non-linear frequency coupling. This is achieved through the selection of small hole size and distribution/density (open area ratio) to achieve high-velocity jetting in the non-linear flow regime. As a result significant energy dissipation is achieved via turbulent mixing at both resonant and non-resonant frequencies, further increasing attenuation bandwidth.

To maximize the exposure of refrigerant flow to the resonators, the spacing between the plates 130 and 132 (between their respective adjacent faces along the flowpath) may preferably be small but not to the point or unduly restricting fluid flow and thereby compromising efficiency. Thus, exemplary separation is 10 mm to 100 mm or 20 mm to 60 mm.

Exemplary recess depth is 2 mm to 50 mm or 3 mm to 35 mm or 5 mm to 25 mm. This may be measured as an average (e.g., mean or median, value) or at a single location. Exemplary transverse recess dimensions are characterized by cavity hydraulic diameter with exemplary embodiments having ranges of hydraulic diameters of 5 mm to 60 mm, or 10 mm to 50 mm, or 18 mm to 42 mm.

The combination of recess planform and aperture size and distribution may cause the apertures to cover an exemplary 5% to 30% or 6% to 20% of the planform of the recesses (the open area percentage). As is discussed below, this open area percentage or ratio may be a parameter optimized for performance over a give target operational condition range.

Figure 7:
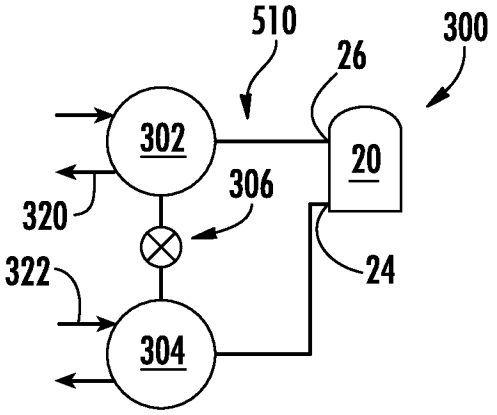
FIG. 7 is a schematic view of a vapor compression system including the compressor.

FIG. 7 shows a vapor compression system 300 including the compressor 20. The exemplary vapor compression system 300 is a basic chiller wherein a refrigerant flowpath 510 from the compressor proceeds sequentially through a condenser 302 and a cooler 304 prior to returning to the compressor. Exemplary coolers may serve as evaporators to absorb heat from and cool a flow 322 of water or other heat transfer liquid for various heating ventilation and air conditioning (HVAC) purposes. Similarly, the condenser rejects heat to a flow 320 of air or water. FIG. 7 also shows an expansion device 306 such as an electronic expansion valve. More complex vapor compression systems may be implemented.

Additionally, various different compressor configurations may be used including compressors with economizer ports, three-rotor compressors, and the like. Although the exemplary compressor is shown having an unloading piston 190 (FIG. 3), other unloading devices, or none at all, may be present.

Figure 8:
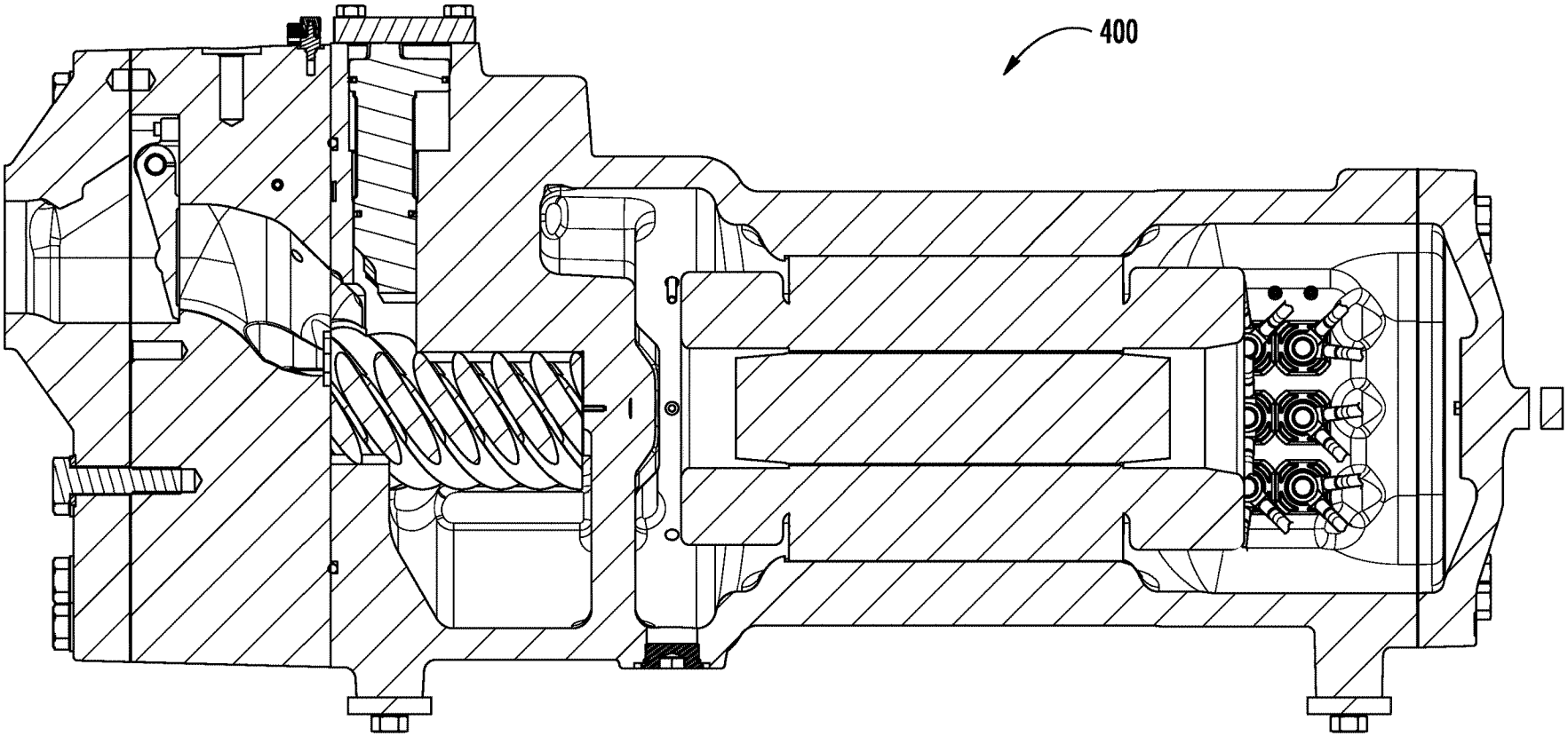
FIG. 8 is a longitudinal vertical sectional view of a baseline compressor.

FIG. 8 shows a baseline compressor 400 as merely illustrative of a configuration of compressor without resonators to which resonators may be applied to yield the exemplary configuration discussed above. In this situation, there is essentially no offset between the dis charge port and the downstream end of the discharge plenum in the bearing case. Thus, the discharge port is transversely offset from the discharge valve seat opening so as to be non-overlapping in axial projection. Furthermore, there is line-of-sight between the discharge port and the rotors. In other configurations, even if there is no line-of-sight between the discharge port and the rotors, the flowpath may only make a slight departure from linear thus allowing pulsations to easily propagate. An exemplary baseline system including the compressor of FIG. 8 would therefore include an external muffler assembly intervening before the associated condenser.

Also, although unfilled resonator cells are shown, the possibility exists of filling with a porous media such as glass or polymeric fiber, polymeric foam, expanded bead material (e.g., expanded polypropylene), and the like. The filling may compromise the pure resonator function but may make up for it via damping or other attenuation. Thus, the resonators may more broadly be characterized as cavities because they may have non-resonator functionality.

Figure 9:
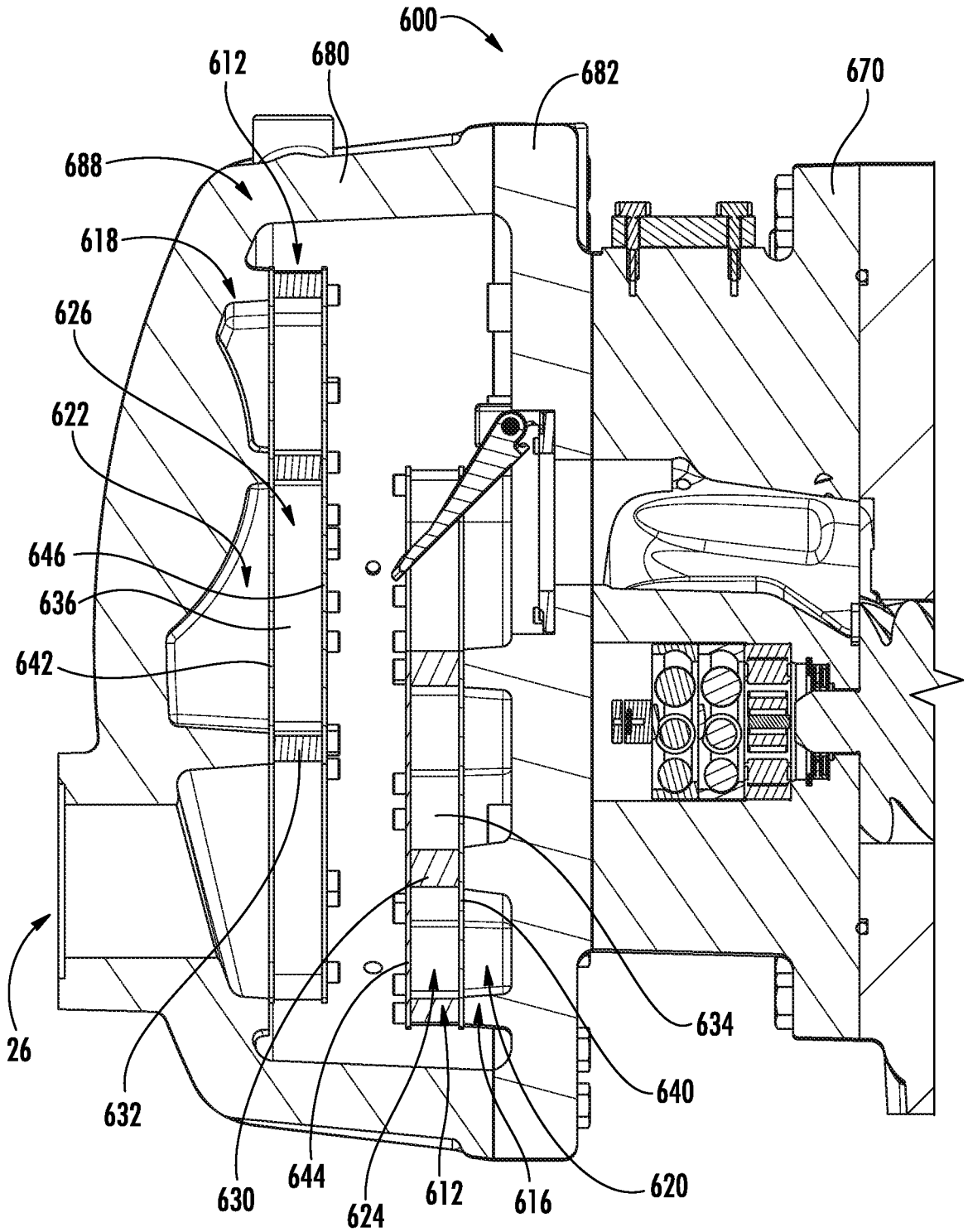
FIG. 9 is an enlarged view of a discharge end of a second compressor.

Yet another variation involves multi-layer resonators. One example of a compressor 600 (FIG. 9) would place an additional layer/array/group 612, 614 of resonators 624, 626 atop a layer/array/group 616, 618 of resonators 620, 622 such as 120 and 122 above. The addition could comprise a thick plate 630, 632 having large through holes 634, 636 to form cells of the second resonator layer placed atop the foraminate or apertured cover 640, 642 (similar to 130, 132) and then another foraminate or apertured cover 644, 646 atop the plate.

Thus, the planform of the intact portions of the plates 630 and 632 may correspond to the planform layout of the underlying walls separating cells in the resonators 620, 622. For each of the thick plates 630 and 632, a single set of fasteners (e.g., screws) may send through that plate and the associated foraminate plates along both of its respective faces and into the adjacent case component 682 and 680. It is thus seen that the exemplary compressor 600 has a slightly different arrangement of major case components reflecting a slightly different baseline compressor. Thus, the discharge valve is not mounted in the bearing case 670 but rather mounted in an additional case member 682 intervening between the bearing case 670 and the discharge case 680 and dividing the cells of the resonators 620.

In an exemplary reengineering from a baseline compressor without such resonators, the compressor 600 may necessitate a lengthening of the discharge housing 680 to accommodate the longitudinal space occupied by the additional resonator layers. Otherwise, construction details and techniques may be similar to those described above for the first compressor and to any baseline compressor.

The compressor and chiller system may be made using otherwise conventional or yet-developed materials and techniques.

The use of "first", "second", and the like in the description and following claims is for differentiation within the claim only and does not necessarily indicate relative or absolute importance or temporal order. Similarly, the identification in a claim of one element as "first" (or the like) does not preclude such "first" element from identifying an element that is referred to as "second" (or the like) in another claim or in the description.

One or more embodiments have been described. Nevertheless, it will be understood that various modifications may be made. For example, when applied to an existing basic system, details of such configuration or its associated use may influence details of particular implementations. Accordingly, other embodiments are within the scope of the following claims.

What is claimed is:

1. A compressor (20; 600) comprising:

a housing assembly (22) having a plurality of ports including a suction port (24) and a discharge port (26), an upstream to downstream flow direction being from the suction port to the discharge port;

a male rotor (30) mounted for rotation about an axis (500);

a motor (40) contained by the housing assembly and having a stator and a rotor, the motor rotor mounted on an upstream shaft of the male rotor for driving rotation of the male rotor about the male rotor axis;

a female rotor (32) enmeshed with the male rotor and mounted in the housing assembly for rotation about an axis (502) for drawing a flow from the suction port, compressing the flow, and discharging the compressed flow through the discharge port;

a cavity (120, 122; 620, 622, 624, 626) group (116, 118; 612, 614, 616, 618) between the discharge port and the male rotor and female rotor, the cavity group comprising:

a first member (124, 80; 682, 680, 630, 632) separating a plurality of cells; and a foraminate cover (130, 132; 640, 642, 644, 646) member atop the first member.

2. The compressor of claim 1 wherein:

the cavity group is a resonator group.

3. The compressor of claim 1 wherein:

the first member is a unitary single piece first member.

4. The compressor of claim 1 wherein:

the foraminate cover is a flat plate.

5. The compressor of claim 1 wherein:

the foraminate cover has a characteristic thickness and holes of characteristic diameter between 1.0 times and 2.0 times said characteristic thickness.

6. The compressor of claim 5 wherein:

the plurality of cells form respective cavities of the cavity group; and there are at least ten holes per cavity for a plurality of the cavities.

7. The compressor of claim 5 wherein:

the characteristic thickness is 1.5 mm to 3.0 mm.

8. The compressor of claim 1 wherein:

the cells are unfilled.

9. The compressor of claim 1 wherein:

the cells have hydraulic diameters of 10 mm to 50 mm.

10. The compressor of claim 1 wherein the cavity group is a first cavity group and the compressor further comprises:

a second cavity group between the discharge port and the male rotor and female rotor, the second cavity group positioned opposite the first cavity group about a flowpath (510) through the compressor and comprising:

a unitary single-piece first member separating a plurality of cells; and a foraminate cover member atop the unitary single-piece first member.

11. The compressor of claim 10 wherein:

a separation between the first cavity group and the second cavity group is 20 mm to 60 mm.

12. The compressor of claim 10 wherein:

the foraminate cover members of the first cavity group and the second cavity group are parallel.

13. The compressor of claim 10 wherein:

the foraminate cover members of the first cavity group and the second cavity group are orthogonal to the rotation axes (500, 502) of the male rotor and female rotor.

14. The compressor of claim 1 wherein:

a central barrier (160) splits a flowpath (510) along the cavity group.

15. The compressor of claim 1 wherein:

the cavity group is along a flowpath between a discharge plenum in a bearing case and the discharge port; and the discharge port is offset from a downstream end (110) of the discharge plenum transversely to rotation axes of the one or more working elements.

16. A vapor compression system (300) comprising the compressor of claim 1, and further comprising:

a heat rejection heat exchanger (302);

a heat absorption heat exchanger (304); and a flowpath from the discharge port sequentially through the heat rejection heat exchanger and heat absorption heat exchanger and returning to the suction port.

17. The vapor compression system of claim 16 being a chiller.

18. A method for operating vapor compression system of claim 16, the method comprising:

driving rotation of the male rotor and the female rotor to draw the flow from the suction port, compress the flow, and discharge the compressed flow through the discharge port; and the compressed flow passing along the cavity group.

19. The method of claim 18 wherein the cavity group acts as a resonator array to partially cancel pulsations.

20. The compressor of claim 1 wherein:

holes in the foraminate member form openings to compartments formed by the cells.

21. A compressor (20; 600) comprising:

a housing assembly (22) having a plurality of ports including a suction port (24) and a discharge port (26);

a male rotor (30) mounted for rotation about an axis (500);

a female rotor (32) enmeshed with the male rotor and mounted in the housing assembly for rotation about an axis (502) for drawing a flow from the suction port, compressing the flow, and discharging the compressed flow through the discharge port;

a discharge valve (106) having a discharge valve seat (101), the discharge valve seat having an opening (103), wherein the discharge port is transversely offset from the discharge valve seat opening so as to be non-overlapping in axial projection; and a cavity (120, 122; 620, 622, 624, 626) group (116, 118; 612, 614, 616, 618) between the discharge port and the male rotor and female rotor, the cavity group comprising:

a first member (124, 80; 682, 680, 630, 632) separating a plurality of cells; and a foraminate cover (130, 132; 640, 642, 644, 646) member atop the first member.

22. The compressor of claim 21 wherein:

the cavity group (116; 616, 612) is at a discharge end of a bearing case (70; 670).

23. The compressor of claim 22 wherein:

the first member (124; 682) is mounted to the discharge end of the bearing case (70).

24. The compressor of claim 21 further comprising:

a motor (40) contained by the housing assembly.

25. A compressor (20; 600) comprising:

a housing assembly (22) having a plurality of ports including a suction port (24) and a discharge port (26);

a male rotor (30) mounted for rotation about an axis (500);

a female rotor (32) enmeshed with the male rotor and mounted in the housing assembly for rotation about an axis (502) for drawing a flow from the suction port, compressing the flow, and discharging the compressed flow through the discharge port;

a cavity (120, 122; 620, 622, 624, 626) group (116, 118; 612, 614, 616, 618) between the discharge port and the male rotor and female rotor, the cavity group comprising:

a first member (124, 80; 682, 680, 630, 632) separating a plurality of cells; and a foraminate cover (130, 132; 640, 642, 644, 646) member atop the first member, wherein:

a central barrier (160) splits a flowpath (510) along the cavity group; and the central barrier (160) projects from a discharge cover (80) toward the cavity group (116).

* * * * *